US008974351B2

(12) United States Patent
Wallisch

(10) Patent No.: US 8,974,351 B2
(45) Date of Patent: Mar. 10, 2015

(54) BI-DIRECTIONAL WRIST EXERCISE DEVICE

(76) Inventor: Michael Dane Wallisch, Carlisle, PA (US)

( * ) Notice: Subject to any disclaimer, the term of this patent is extended or adjusted under 35 U.S.C. 154(b) by 243 days.

(21) Appl. No.: 13/567,439

(22) Filed: Aug. 6, 2012

(65) Prior Publication Data

US 2014/0038784 A1 Feb. 6, 2014

(51) Int. Cl.
*A63B 23/14* (2006.01)

(52) U.S. Cl.
USPC ..... 482/45; 482/44; 482/46

(58) Field of Classification Search
CPC .. A63B 23/14; A63B 21/00069; A63B 23/16; A63B 21/023; A63B 21/1469; A63B 21/1496; A63B 21/05
USPC ..... 482/44–50, 92, 121, 122, 126, 127
See application file for complete search history.

(56) References Cited

U.S. PATENT DOCUMENTS

| | | | | |
|---|---|---|---|---|
| 4,770,409 | A | 9/1988 | Wallisch | |
| 4,938,477 | A * | 7/1990 | Kuervers | 482/105 |
| 7,094,182 | B1 * | 8/2006 | Holten | 482/46 |
| 8,602,951 | B2 * | 12/2013 | Morris | 482/126 |
| 2013/0331233 | A1 * | 12/2013 | Wilson | 482/46 |

* cited by examiner

*Primary Examiner* — Loan H Thanh
*Assistant Examiner* — Andrew S Lo
(74) *Attorney, Agent, or Firm* — The Webb Law Firm

(57) ABSTRACT

A wrist exercise device includes a housing having circular portions, a grip handle extending across an inner area of each circular portion of the housing, with both ends of each grip handle being rotatably engaged in a circular direction with the circular portion of the housing, and a spring positioned within each circular portion of the housing. The elastic force of the spring between the grip handle and the housing is increased when the grip handle rotates in any direction.

13 Claims, 5 Drawing Sheets

BI-DIRECTIONAL WRIST EXERCISE DEVICE

BACKGROUND OF THE INVENTION

1. Field of the Invention

The present invention relates to a wrist exercise device, in particular, a wrist exercise device used for strengthening the muscles of the forearm.

2. Description of Related Art

Devices adapted to exercise the muscles of the aim are known in the art. See, for example, the wrist exercise device disclosed in U.S. Pat. No. 4,770,409 to Wallisch, which is hereby incorporated by reference as if set forth in its entirety herein. As shown in FIG. 1, which shows the device disclosed in U.S. Pat. No. 4,770,409, the prior wrist exercise device includes a housing formed in a figure eight shape and with adjacent circular portions 105 having an annular channel, an arcuate slide 110 positioned within the channel and in slidable engagement therewith, a grip handle 114 extending across an inner area of each circular portion 105 and connected to one of said arcuate slides 110, a stop 116 positioned within each annular channel and disposed adjacent one end 111 of each of said arcuate slides 110, and spring means 118 positioned within each annular channel and extending between said stop 116 and the other end 112 of each of the arcuate slides 110. That is, each grip handle 114 is pushed against the stop 116 at a locked position. When using this prior wrist exercise device, the grip handles 114 are grasped by user's hand in a locked position and are turned against the resistance of the spring means 118. For example, the left handle 114 is turned counter-clockwise (direction A in FIG. 1), and the right handle 114 is turned clockwise (direction B in FIG. 1). Then, the grip handles 114 are returned to the locked position as user loosens his or her force.

However, when the user wants to strengthen the different muscles that are used for opposite rotation of his or her wrist, the device has to be turned over, and the grip handles 114 are grasped again by user's hand in a locked position. Then, the grip handles 114 are turned against the resistance of the spring means 118. For example, the left handle is turned clockwise, and the right handle is turned counter-clockwise.

SUMMARY OF THE INVENTION

According to a particular, non-limiting embodiment of the present invention, a wrist exercise device is provided, which allows for an effective exercise of the muscles of the forearm through rotation of the wrist against spring provided resistance in opposing directions.

According to one embodiment of the present invention, a wrist exercise device is provided. The wrist exercise device includes a housing having circular portions; a grip handle extending across an inner area of each circular portion of the housing, with both ends of each grip handle engaged rotatably in a circular direction with the circular portion of the housing; and at least one spring positioned within each circular portion of the housing. The at least one spring engages the grip handle and the housing to increase an elastic force of the spring between the grip handle and the housing when the grip handle rotates in any direction.

The at least one spring arranged in each circular portion includes a first spring and a second spring. The elastic force of the first spring between the grip handle, and the housing is increased when the grip handle rotates in one direction, and the elastic force of the second spring between the grip handle and the housing is increased when the grip handle rotates in another direction. One end of the first spring may be connected to one end of the grip handle and one end of the second spring may be connected to another end of the grip handle. The first spring and the second spring may be configured to have a same length and same elasticity.

The wrist exercise device may further include a stop positioned within each circular portion and being configured to fix the first spring and the second spring on the housing.

The grip handle arranged in each circular portion may include an arcuate slide portion, and each circular portion of the housing may have an annular channel defined therein. The arcuate slide portion may be positioned within the annular channel of each circular portion of the housing and may be slidably engaged therewith.

According to another embodiment of the present invention, a wrist exercise device is provided. The wrist exercise device includes a housing formed with adjacent circular portions, with each circular portion of the housing having an annular channel defined therein; a grip handle extending across an inner area of each circular portion of the housing, with each end of the handle positioning within the annular channel of each circular portion of the housing and in slidable engagement therewith; a stop positioned within each annular channel; a first spring positioned within each annular channel and extending between the stop and one end of the respective handle; and a second spring positioned within each annular channel and extending between the stop and the other end of the respective handle.

According to another embodiment of the present invention, a wrist exercise device is provided. The wrist exercise device includes a housing formed in a figure eight shape and with adjacent circular portions, with each circular portion of the housing having an annular channel defined therein; an arcuate slide positioned within the annular channel of each circular portion of the housing and in slidable engagement therewith; a grip handle extending across an inner area of each circular portion of the housing and connected to one of the arcuate slides; a stop positioned within each annular channel; a first spring positioned within each annular channel and extending between the stop and one end of the respective arcuate slide; and a second spring positioned within each annular channel and extending between the stop and the other end of each of the respective arcuate slide.

The housing may be formed of a top housing removably secured to a bottom housing, with the top and bottom housings each having a pair of annular grooves formed therein, with the annular grooves together forming the annular channels when the top and bottom housings are secured together and the annular grooves are aligned. Inner peripheral edges of the circular portions of the top and bottom housings may be spaced apart from each other and the arcuate slides may each have an inwardly directed shoulder which extends through the space between the inner peripheral edges.

Further details and advantages of the invention will become clear upon reading the following detailed description in conjunction with the accompanying drawing figures, wherein like parts are designated with like reference numerals throughout.

DESCRIPTION OF THE PREFERRED EMBODIMENTS

Figure 1:
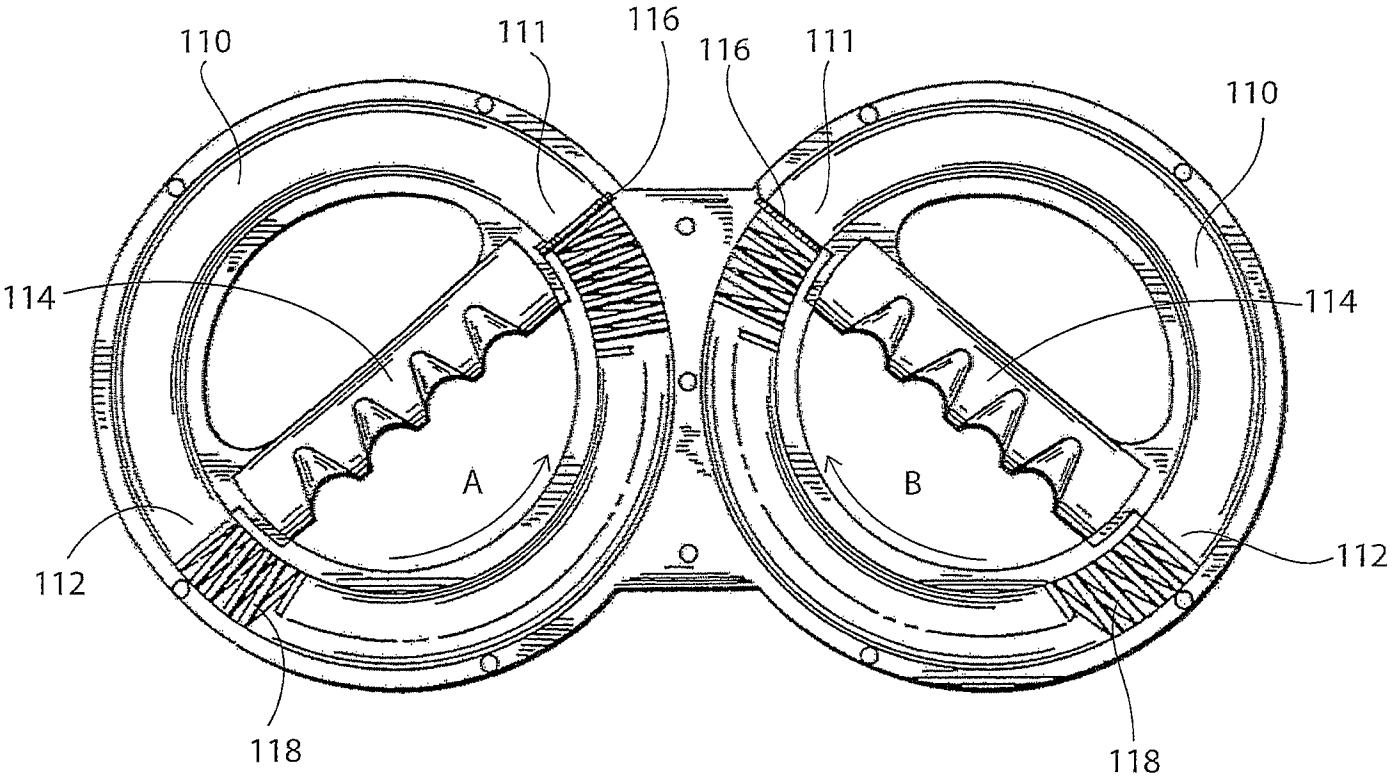
PRIOR ART FIG. 1
FIG. 1 is a top plan view of a prior art wrist exercise device.

For purposes of the description hereinafter, the terms "end", "upper", "lower", "right", "left", "vertical", "horizontal", "top", "bottom", "lateral", "longitudinal" and derivatives thereof shall relate to the invention as it is oriented in the drawing figures. However, it is to be understood that the invention may assume various alternative variations and step sequences, except where expressly specified to the contrary. It is also to be understood that the specific devices and processes illustrated in the attached drawings, and described in the following specification, are simply exemplary embodiments of the invention. Hence, specific dimensions and other physical characteristics related to the embodiments disclosed herein are not to be considered as limiting. Further, it is to be understood that the invention may assume various alternative variations and step sequences, except where expressly specified to the contrary.

Figure 2:
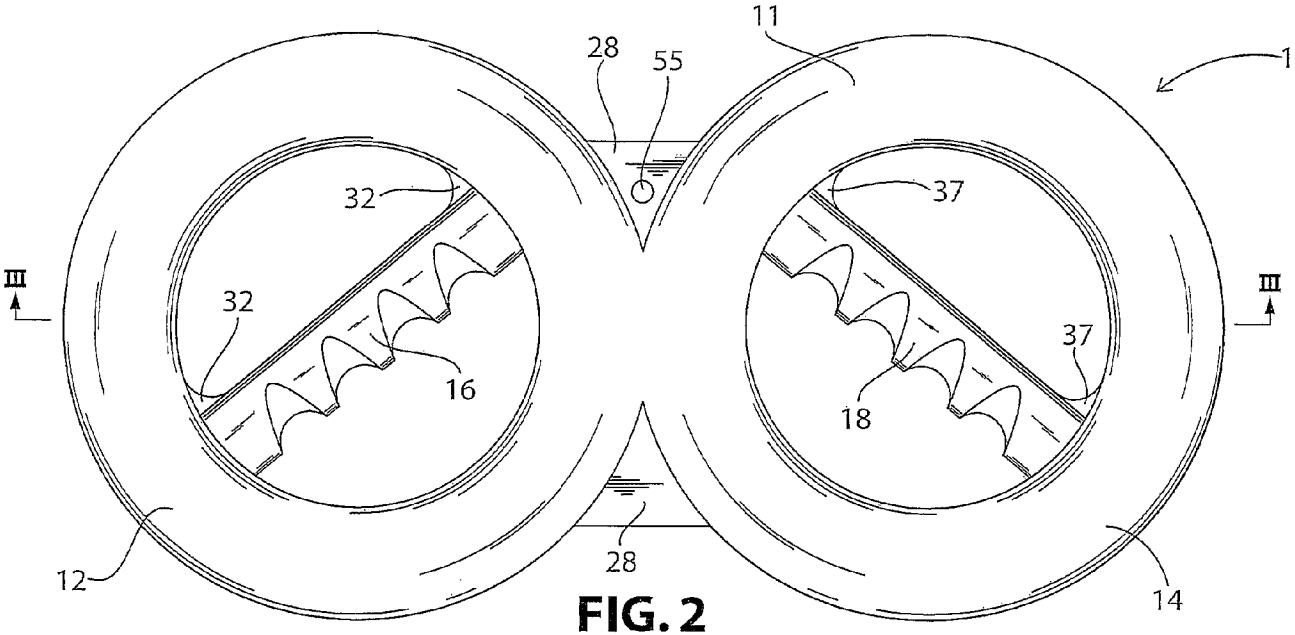
FIG. 2 is a top view of a wrist exercise device according to one embodiment of the present invention.
Figure 3:
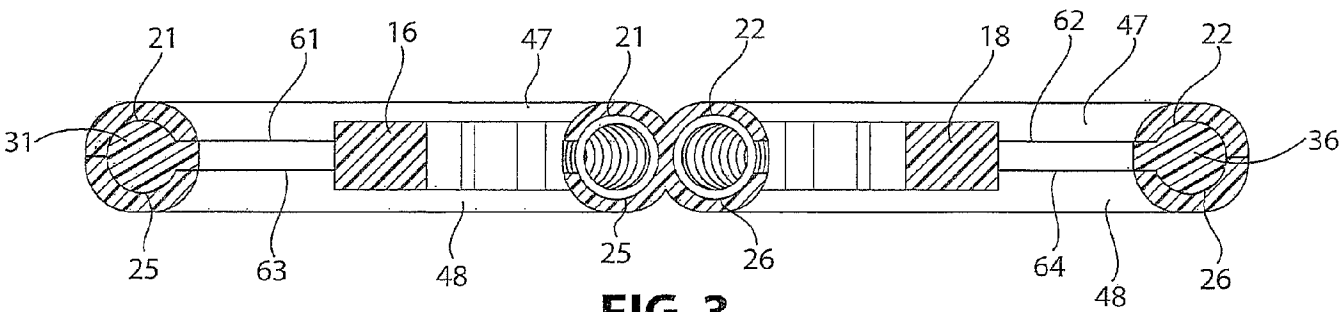
FIG. 3 is a cross-sectional view of the wrist exercise device shown in FIG. 2.
Figure 4:
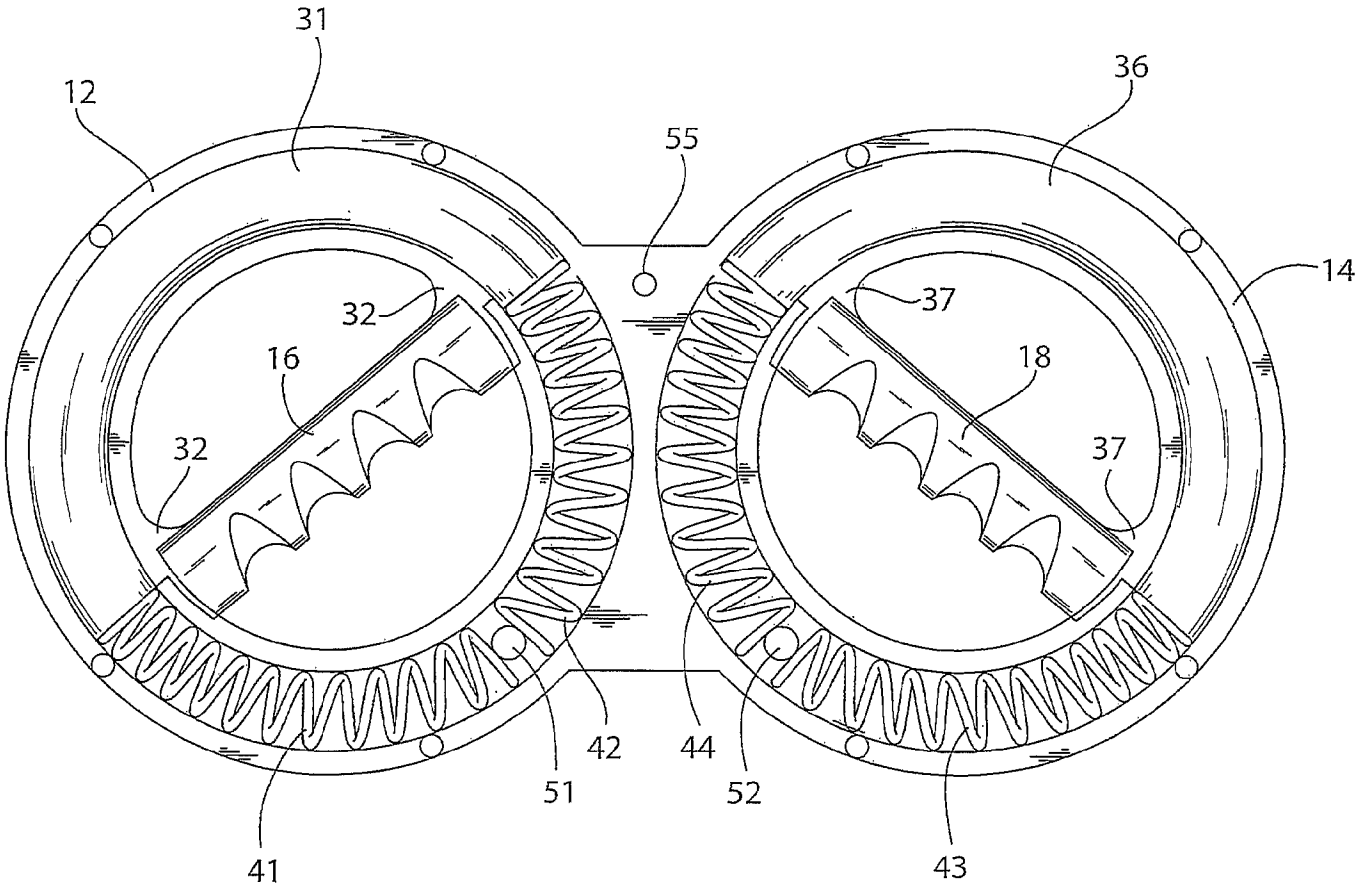
FIG. 4 is a top plan view of a wrist exercise device according to one embodiment of the present invention.

Referring to FIGS. 2-4, one embodiment of a wrist exercise device 1 includes a housing 11 having a pair of circular portions 12 and 14 which are connected to each other, a pair of grip handles 16 and 18 engaged in each circular portion 12, 14 of the housing 11, a pair of arcuate slides 31 and 36 slidably engaged with each circular portion 12, 14 of the housing 11, and springs 41-44 positioned within each circular portion 12, 14 of the housing 11.

In this embodiment, the circular portions 12 and 14 are arranged adjacently, hence the housing 11 is formed in a figure eight shape. The housing 11 is preferably formed in two parts, namely, top housing 47 and bottom housing 48, which are joined together to form a rigid, unitary housing structure. Top housing 47 may be joined to bottom housing 48 by known fastening means, such as screws, rivets, bolts, glue or the like. Wider reinforcement areas 28 and 28 may be provided in the housing where the circular portions 12 and 14 are close to each other. In the reinforcement area 28, the top housing 47 and the bottom housing 48 are preferably fastened by a reinforcement screw 55.

Each circular portion 12, 14 includes an interior annular channel defined by the top housing 47 and the bottom housing 48 when connected. In this embodiment, each circular portion 12, 14 of the top housing 47 respectively includes an annular groove 21, 22, formed about the inner periphery thereof. Likewise, each circular portion 12, 14 of the bottom housing 48 also respectively includes an annular groove 25, 26 formed about the inner periphery thereof. When the top housing 47 and bottom housing 48 are secured together, the annular grooves 21 and 22 of the top housing 47 are aligned with the annular grooves 25 and 26 of the bottom housing 48, respectively. The grooves 21 and 25 in one circular portion form the annular channel in one circular portion 12 and the grooves 22 and 26 in another circular portion form the annular channel in another circular portion 14. As shown in FIGS. 3 and 4, the grooves are preferably semi-circular in cross section and, as a result, the annular channels in circular portions 12, 14 are preferably circular in cross section.

In this embodiment, stops 51 and 52 are positioned within each annular channel and are fixed firmly to the housing 11. The stops 51, 52 may be configured to be able to secure one end of the springs 41-44 to the housing 11. The stops may be formed by known stopping means, such as screws, bolts, rigid plates formed as metal or plastic disks, or the like. One manner of affixing the one end of the spring to the housing is to provide a screw with an engaging member (not shown) which is configured to be able to catch the one end of the spring and is fixed to the housing by the screw. In another embodiment, the stops may be configured to be able to secure one end of the springs when the springs are compressed. For example, disk-type stops, having larger circumference than the annular grooves and being fixed to a slot cut perpendicular to the annular grooves, are used for this purpose.

The stops 51 and 52 may be adjustably positioned at any location within the annular grooves and, thereby, result in a change in the annular position of the grip handles 16 and 18 relative to the housing 11. Other stop devices, such as inwardly directed tabs and the like, may also be used to secure one end of the springs.

Furthermore, the stops 51 and 52 of this embodiment are screws which are also able to fasten the top housing 47 and the bottom housing 48.

The arcuate slides 31 and 36 are positioned within the annular channel of the circular portions 12 and 14 of the housing 11 respectively and can freely slide therein. In addition, grip handles 16 and 18 extend across an inner, open area of the circular portions 12 and 14 respectively and are securely affixed to associated arcuate slides 31 and 36. As shown in the figures, arcuate slide 31 is positioned within the annular channel in circular portion 12, and grip handle 16 is connected thereto and extends across the inner area of circular portion 12. Similarly, arcuate slide 36 is positioned within the annular channel in circular portion 14, and grip handle 18 is connected thereto and extends across the inner area of circular portion 14.

The spring, such as a compression resistant coil spring, a torsion spring, an elastic member, a pneumatic or hydraulic piston and cylinder device, or the like, is positioned within the annular channel of each circular portion. In this embodiment, two coil springs 41, 42 or 43, 44 are positioned within the annular channel of each circular potion 12, 14. Each coil spring 41-44 extends along the channel between the stop 51, 52 and the end of each arcuate slide 31, 36. More specifically, one coil spring 41 extends from one side of the stop 51 to the one end of the arcuate slide 31, and another coil spring 42 also extends from another side of the stop 51 to another end of the arcuate slide 31, in one circular portion 12. Likewise, one coil spring 43 extends from one side of the stop 52 to the one end of the arcuate slide 36, and another coil spring 44 also extends from another side of the stop 52 to another end of the arcuate slide 36, in another circular portion 14.

According to one embodiment, one end of each coil spring may be fixed to the stop, and another end of each coil spring may be fixed to the arcuate slide, so that the springs cannot only provide resistance to compression, but also provide resistance to stretching. According to this structure, two springs located on both sides of the stop can provide the resistance to the arcuate slide at the same time when the grip handle is rotated. In this embodiment, the wrist exercise device can provide stronger resistance.

In another embodiment, the end of the coil spring may not be fixed to the stop or the arcuate slide, so that the spring can provide only resistance to compression. According to this structure, only one of two springs in each circular portion which is compressed can provide the resistance to the arcuate slide when the grip handle is rotated. In this embodiment, the wrist exercise device can provide weaker resistance.

Preferably, each spring has the same length and same elasticity as that of others. In this case, as shown in FIG. 4, at the neutral position, the arcuate slides 31, 36 are located on opposite sides of the stops 51, 52.

When the top housing 47 is joined to the bottom housing 48, the outer peripheral edges are in contact with each other. However, the inner peripheral edges are spaced apart and do not contact each other. As shown in FIGS. 3 and 4, an inner peripheral edge 61 of the top housing 47 in one circular portion 12 is spaced from the adjacent inner peripheral edge 63 of the bottom housing 48 in one circular portion 12 and an inner peripheral edge 62 of the top housing 47 in another circular portion 14 is spaced from the adjacent inner peripheral edge 64 of the bottom housing 48 in another circular portion 14. Each arcuate slide 31, 36 has an inwardly directed shoulder 32, 37 which extends through the inner peripheral spacing between the top housing 47 and the bottom housing 48. As shown in FIGS. 3 and 4, arcuate slide 31 has inwardly directed shoulder 32 integral therewith which extends between peripheral edges 61 and 63. Likewise, arcuate slide 36 has an inwardly directed shoulder 37 integral therewith which extends between peripheral edges 62 and 64. Preferably the shoulders 32, 37 are substantially flush with the peripheral edges 61-64. In this manner, the arcuate slides 31 and 36 may securely move within the annular channels and be fastened to the grips 16 and 18, and the grips 16 and 18 may be rotated within the inner area of each circular portion without frictionally contacting the housing.

Each arcuate slide 31, 36 preferably extends along one-half the circumferential length of the associated annular channel. The springs 41-44 will occupy the remainder of the annular channels, except for the space occupied by the stops 51, 52. The springs 41-44 each have a diameter less than or the same as the diameter of the annular channels in which they are positioned.

In this embodiment, while two springs are used in each annular channel, one continuous spring can be used alternatively. In this case, the center portion of the one continuous spring is fixed to the housing by the stop, and both sides of the center portions are configured to be able to provide a resistance to the arcuate slide respectively. The end of the continuous coil spring may be preferably fixed to the arcuate slide.

In a preferred embodiment, the grips 16 and 18 are inclined toward each other at a 45° angle. As shown in FIG. 4, grip 16 is angled inwardly toward a similarly angled grip 18, both at a 45° angle. The particular angular position of the slide/grip combination can be easily adjusted by changing the position of the stop in a particular annular groove.

The housing 11 and the slides 31, 36 are formed of a material having high stress resistance and high friction resistance, such as plastic, metal, wood, or the like, with plastic being preferred. The grips 16, 18 are formed of a material which can withstand the torque created as the arcuate slides 31, 36 are rotated against the springs 41-44, such as plastic, metal, wood or the like.

The arcuate slide/grip combination may be formed of the same material in a unitary structure, such as molded plastic, or may be formed of different materials. A structure having a plastic arcuate slide joined to a wooden grip has proven to be satisfactory. The grips 16 and 18 may each be provided with a plurality of finger indentations, preferably four on each grip, to improve the gripping surface thereof. Alternatively, the grips may be provided with a knurled surface or coated with a grip enhancing material.

Figure 5:
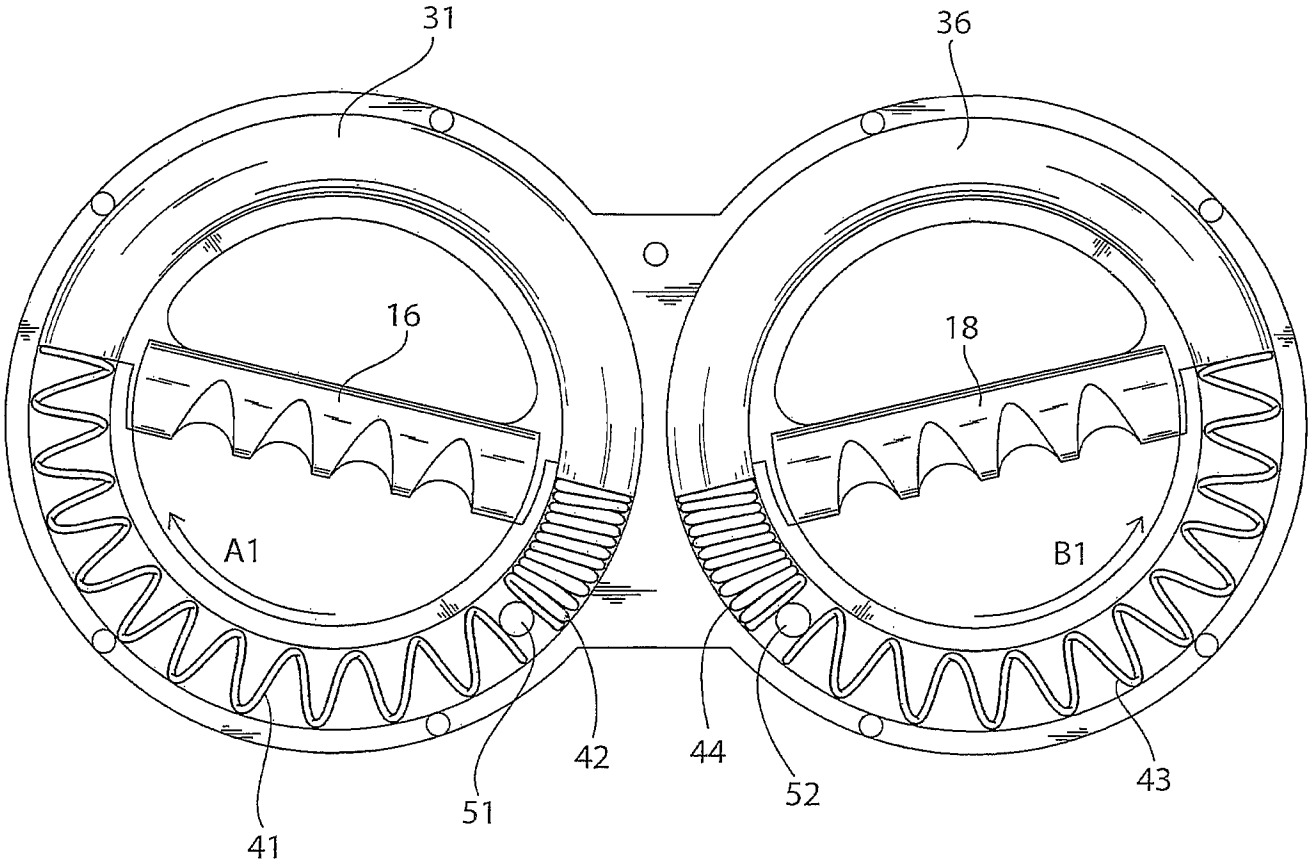
FIG. 5 is a top plan view of the wrist exercise device shown in FIG. 4, showing a situation where the grip handle is rotated in one direction.

In practicing the wrist exercise device of the present invention, the grips 16 and 18 are grasped by a user's hand with the wrist in a neutral position as shown in FIG. 4 and then turned inwardly or outwardly. The turning of the hands rotates each arcuate slide 31, 36 against the associated springs. More specifically, when grip 16 is rotated clockwise as shown by arrow A1 in FIG. 5 and grip 18 is rotated counterclockwise as shown by arrow B1 in FIG. 5, the springs 42 and 44 are compressed and the springs 41 and 43 are stretched. The force of rotation will meet with increasing resistance as the compression and the stretching of the springs from their normal positions increase. Upon completed compression and stretching of the springs, the wrist is returned to its relaxed position, thereby releasing the compression and stretching and allowing the springs to be a normal length at the neutral position as shown in FIG. 4.

Figure 6:
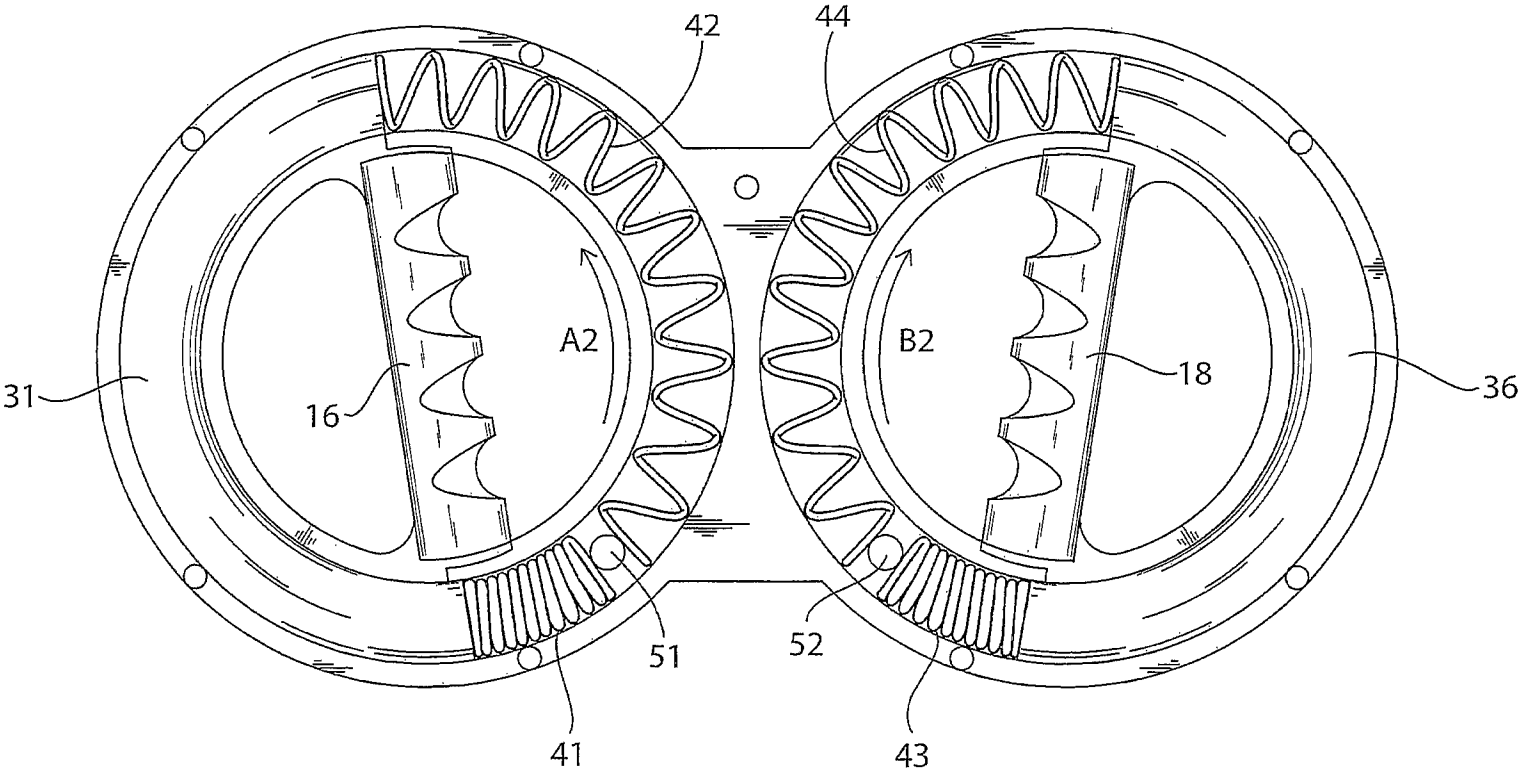
FIG. 6 is a top plan view of the wrist exercise device shown in FIG. 4, showing a situation where the grip handle is rotated in another direction.

And then, according to the present invention, the grips 16 and 18 can be turned in opposite directions without turning over the entire device 1. More specifically, grip 16 can be rotated counterclockwise as shown by arrow A2 in FIG. 6, and grip 18 can be rotated clockwise as shown by arrow B2 in FIG. 6. In this case, the springs 42 and 44 are stretched and the springs 41 and 43 are compressed. The force of rotation will meet with increasing resistance as the compression and the stretching of the springs from their normal positions increase. Upon completed compression and stretching of the springs, the wrist is returned to its relaxed position, thereby releasing the compression or stretching and allowing the springs to be a normal length at the neutral position as shown in FIG. 4.

As a result, the user may rotate his or her wrist in both inward and outward directions continuously without turning over the device, so the user can strengthen his or her muscles effectively. Therefore, according to the present invention, a wrist exercise device which allows for an effective exercise of the muscles of the forearm is provided. Furthermore, the present invention may be used in any position, horizontal, vertical, or intermediate, and both wrists may be exercised simultaneously, or each wrist may be exercised individually. Regardless of the specific training method used, if a routine of compression and relaxation of the spring is practiced, the hand muscles, wrist muscles, and forearm muscles will be effectively exercised.

Although the invention has been described in detail for the purpose of illustration based on what is currently considered to be the most practical and preferred embodiments, it is to be understood that such detail is solely for that purpose and that the invention is not limited to the disclosed embodiments but, on the contrary, is intended to cover modifications and equivalent arrangements that are within the spirit and scope of the description. For example, it is to be understood that the present invention contemplates that, to the extent possible, one or more features of any embodiment can be combined with one or more features of any other embodiment.

The invention claimed is:

1. A wrist exercise device, comprising:

a housing having at least two adjacent circular portions, each circular portion of the housing having an annular channel defined therein; and at least two grip handles, each grip handle having a first end and a second end and extending across an inner area of a respective one of the at least two circular portions of the housing such that the first end and the second end of the grip handle are positioned within the annular channel of the respective one of the at least two circular portions and in slidable engagement therewith, wherein each of the at least two adjacent circular portions includes a stop positioned within the annular channel thereof, a first spring disposed within the annular channel between the stop and the first end of the respective grip handle, and a second spring disposed within the annular channel between the stop and the second end of the respective grip handle, and wherein the stop is positioned within the annular channel between the first spring and the second spring.

2. The wrist exercise device according to claim 1, wherein in each of the at least two adjacent circular portion an elastic force of the first spring between the first end of the respective grip handle and the stop is increased when the grip handle rotates in a first direction, and an elastic force of the second spring between the second end of the respective grip handle and the stop is increased when the grip handle rotates in an opposing second direction.

3. The wrist exercise device according to claim 2, wherein in each of the at least two adjacent circular portions one end of the first spring is connected to the first end of the respective grip handle and one end of the second spring is connected to the second end of the respective grip handle.

4. The wrist exercise device according to claim 2, wherein in each of the at least two adjacent circular portions the first spring and the second spring are configured to have a same length and same elasticity.

5. The wrist exercise device according to claim 2, wherein in each of the at least two adjacent circular portions the stop is configured to fix the first spring and the second spring on the housing.

6. The wrist exercise device according to claim 1, wherein each of the at least two grip handles comprises an arcuate slide portion positioned in the annular channel of the respective one of the at least two adjacent circular portions and slidably engaged therewith, and wherein the arcuate slide portion defines the first and second ends of the grip handle.

7. A wrist exercise device, comprising:

a housing formed in a figure eight shape having two adjacent circular portions, each circular portion of the housing having an annular channel defined therein; and at least two grip handles, each grip handle having a first end and a second end and extending across an inner area of a respective one of the two circular portions of the housing such that the first end and the second end of the grip handle are positioned within the annular channel of the respective one of the two circular portions and in slidable engagement therewith, wherein each grip handle includes an arcuate slide slidably positioned within the annular channel of the respective one of the two circular portions of the housing, the arcuate slide defining the first and second ends of the grip handle, wherein each of the two adjacent circular portions includes a stop positioned within the annular channel thereof, a first spring disposed within the annular channel between the stop and the first end of the respective grip handle, and a second spring disposed within the annular channel between the stop and the second end of the respective grip handle, and wherein the stop is positioned within the annular channel between the first spring and the second spring.

8. The wrist exercise device of claim 7, wherein in each of the two adjacent circular portions the first spring and the second spring are configured to have a same length and same elasticity.

9. The wrist exercise device of claim 7, wherein the housing is formed of a top housing removably secured to a bottom housing, with the top and bottom housings each having a pair of annular grooves formed therein, with the annular grooves together forming the annular channels when the top and bottom housings are secured together and the annular grooves are aligned.

10. The wrist exercise device of claim 9, wherein inner peripheral edges of the circular portions of the top and bottom housings are spaced apart from each other, and wherein the arcuate slides each have an inwardly directed shoulder which extends through the space between the inner peripheral edges.

11. The wrist exercise device according to claim 7, wherein in each of the at least two adjacent circular portions an elastic force of the first spring between the first end of the respective grip handle and the stop is increased when the grip handle rotates in a first direction, and an elastic force of the second spring between the second end of the respective grip handle and the stop is increased when the grip handle rotates in an opposing second direction.

12. The wrist exercise device according to claim 11, wherein in each of the at least two adjacent circular portions one end of the first spring is connected to the first end of the respective grip handle and one end of the second spring is connected to the second end of the respective grip handle.

13. The wrist exercise device according to claim 11, wherein in each of the at least two adjacent circular portions the stop is configured to fix the first spring and the second spring on the housing.

* * * * *